United States Patent [19]

Benty

[11] 4,198,558

[45] Apr. 15, 1980

[54] HAIR DRYER

[75] Inventor: John L. Benty, Sands Point, N.Y.

[73] Assignee: Sunbeam Corporation, Chicago, Ill.

[21] Appl. No.: 814,658

[22] Filed: Jul. 11, 1977

[51] Int. Cl.[2] ..... A45D 20/24

[52] U.S. Cl. ..... 219/370; 34/97; 34/243 R; 132/9; 219/367; 219/368; 219/373

[58] Field of Search ..... 219/364, 370, 373, 374, 219/369, 361, 363, 367, 240, 241; 34/96–98, 243 R; 132/7, 9, 11

[56] References Cited

U.S. PATENT DOCUMENTS

| | | | |
|---|---|---|---|
| 2,591,669 | 4/1952 | Bucknell et al. | 219/370 |
| 3,086,698 | 4/1963 | Goldstein | 219/373 |
| 3,397,463 | 8/1968 | Laing | 34/97 |
| 3,846,047 | 11/1974 | Wada et al. | 219/370 |
| 3,981,314 | 9/1976 | Barradas | 34/97 |
| 3,986,272 | 10/1976 | Feierabent | 219/370 |

FOREIGN PATENT DOCUMENTS

| | | | |
|---|---|---|---|
| 633023 | 1/1928 | France | 34/243 R |
| 955965 | 4/1964 | United Kingdom | 219/370 |

*Primary Examiner*—B. A. Reynolds
*Assistant Examiner*—Bernard Roskoski
*Attorney, Agent, or Firm*—George R. Clark; Neil M. Rose; Clifford A. Dean

[57] ABSTRACT

A combination hair drying appliance which can be used either as a gun-type hair blower/dryer or an in-line hair styler/dryer. The two separate uses are created by two separate mechanical configurations of the appliance, each configuration established when the handle portion of the appliance is rotated with respect to the main body portion to become either perpendicular to or in-line with the body portion.

5 Claims, 7 Drawing Figures

HAIR DRYER

BACKGROUND OF THE INVENTION

Portable hand-held hair dryers with heated air outputs have been used extensively both by barbers and in beauty salons as well as by individuals in the home for many years. As the home market has increased in recent years, these appliances have developed primarily in two separate and distinct categories, the blower/dryers and the styler/dryers.

Blower/dryers are used primarily for drying the user's hair and provide a hot concentrated air flow. Such appliances typically have a cylindrical portion from which the hot air exits axially out one end thereof. The air outlet opening is relatively small and thus provides a high velocity concentrated air flow. With the high velocity air flow, the temperatures used in such blower/dryers can be extremely high without creating a risk of internal heat build-up by the heating elements and as such, the drying power of these devices is quite high. The most common blower/dryer configuration is the gun-type unit in which a handle portion extends downwardly at a right angle from the cylindrical body portion of the product. The motor and a centrifugal fan are positioned at the junction of the handle and body portion. Electrical heating elements are provided between the fan and the frontally located air outlet. Attachments such as a brush or comb cannot be used with such blower/dryers and, if brushing or combing is desired for styling, the consumer must use both hands, the blower being held in one and a brush or comb in the other. The gun-type configuration for a blower/dryer, however, is convenient to use and efficient if a second person is drying the actual user's hair, such as a professional hair stylist.

A styler/dryer appliance, on the other hand, is characterized by having various styling attachments, such as a brush or a comb, and typically has an elongated body with a head portion in which the hot air flow exits laterally therefrom. Thus, the appliance can be manipulated in the same fashion as is a common brush with one's hair being dried and styled as the user merely brushes or combs his or her hair. A typical construction of a styler/dryer incorporates a tangential fan within the head portion thereof with the heating elements being positioned between the fan and the lateral air outlet. Such a construction, additionally containing a water spray feature, is disclosed in the Churas et al U.S. Pat. No. 3,905,379. The air outlet contained in styler/dryers is of a larger area than that of the typical blower/dryer and consequently the air exits through this outlet at a lower velocity. This lower velocity and less concentrated air flow will not tend to adversely blow or scatter the user's hair as much as the high velocity air in the blower/dryer, thereby facilitating the styling operation.

The preferred and most efficient manner of preparing one's own hair would be to use a blower with its high temperature and concentrated air flow during the initial drying process and, after the hair has been partially dried, to use a styler/dryer to complete the drying and to properly style the user's hair. In view of these considerations, it would be advantageous to have a single portable hand-held product that would provide the functions and advantages of both a blower/dryer appliance as well as a styler/dryer appliance.

SUMMARY OF THE INVENTION

The present invention provides an improved hair drying appliance which can be used either as a gun-type blower/dryer or, in the alternative, as an elongated styler/dryer with attachments that can be placed on the side thereof. The invention is characterized by a housing including an elongated cylindrical body portion and an elongated handle portion, each portion being attached to the other at one end. Within the main cylindrical body portion, there is provided an air inlet close to the handle end, a small air outlet at the opposite end and a larger air outlet on the side of this body portion. The body portion and the handle portion are rotatable with respect to each other so that one can have a gun-type or pistol configuration with these two portions at right angles to each other or, in the alternative, the handle portion can be rotated to a position in line with the main cylindrical body portion.

When the hair drying appliance of the present invention is used in its gun-type configuration, the hot air flow will exit through the air outlet at the front end and the product will be usable as a typical blower/dryer. In the alternative, the handle portion can be rotated to form an in-line configuration with the main body portion. When the appliance is in this latter configuration, attachments may be mounted on the unit. Each attachment comprises either a brush, comb, or similar hair grooming device, and also has a raised plate portion to block the front end air outlet. In this manner, with this front end blocked, the air flow through the body of the dryer will be directed out of the side-located air outlet and through the particular attachment being used. As such, the present invention can be used as a typical styler/dryer.

Various safety mechanisms have also been incorporated in the present invention including a locking member to secure the main body portion and the handle portion in their respective relative positions or configurations when the appliance is being used either as a blower/dryer or as a styler/dryer. This particular locking member additionally functions to prevent the consumer from using or attaching the grooming attachments when the appliance is in its gun-type blower/dryer configuration.

An additional safety feature incorporated in the present invention is a stop member incorporated with the electrical control switch of the appliance. This stop member prevents the highest wattage use of the dryer when it is in its in-line or styler configuration. This is desirable because with the styler configuration the air flow exiting laterally from the main body is not as great as with the unit in the blower/dryer configuration. By preventing use of the highest wattage in the styler configuration, there will be no damaging temperature rise within the unit. When the appliance is used in the gun-type or blower/dryer configuration, however, the aforementioned switch blockage is not created so that all levels of wattage may be employed.

It is an object of the present invention to provide an improved hair dryer which can be used either as a hair blower or, in the alternative, as a hair styler.

It is another object of the present invention to provide an improved hair dryer which can be mechanically changed to assume two different configurations, each facilitating efficient use of the appliance in preparing one's hair.

It is still a further object of the present invention to provide a hair drying appliance in which the handle portion thereof is rotatable with respect to the main body portion, thereby allowing two different usable configurations of the appliance.

Further objects and advantages of the present invention will become apparent as the following description proceeds and the features of novelty which characterize the invention will be pointed out with particularity in the claims annexed to and forming a part of this specification.

DESCRIPTION OF THE PREFERRED EMBODIMENT

Figures 1, 2:
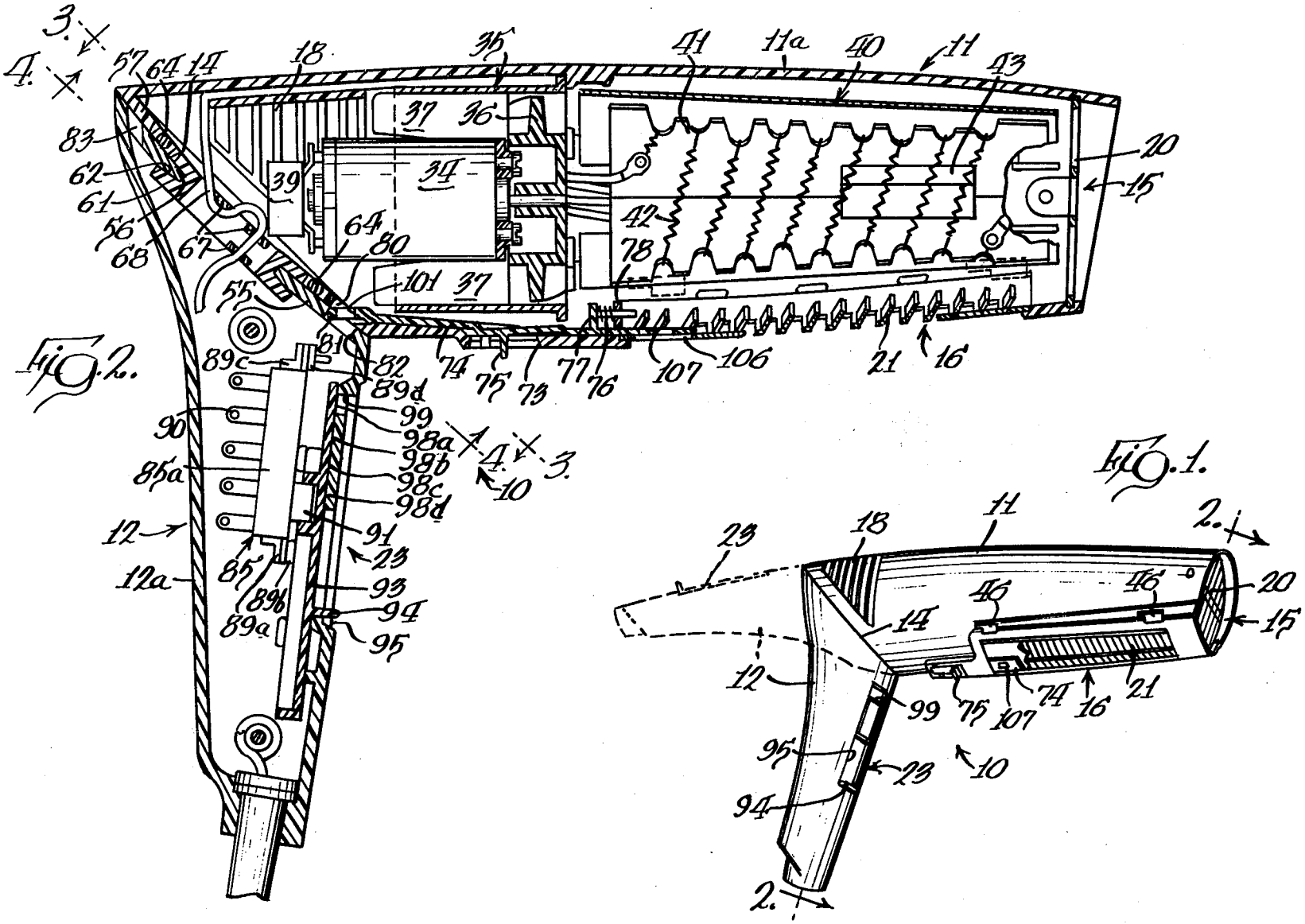
FIG. 1 is a perspective view of the hair drying appliance embodying the present invention with one configuration being shown in full line and with the alternative configuration being shown in dashed lines.
FIG. 2 is a vertical sectional view taken generally on line 2—2 of FIG. 1.

Referring now to the drawings there is shown in FIG. 1 a hair dryer appliance designated generally by reference numeral 10. The hair dryer is shown in its blower/dryer or gun-type configuration with a handle portion 12, having a split plastic housing **12*a*, being positioned at a right angle with respect to a cylindrical body portion 11 having a split plastic housing 11*a*. Also shown in FIG. 1 in dashed lines is the styler/dryer configuration of the appliance 10 wherein the handle 12 is aligned with the cylindrical body portion 11. As will be described more fully below, the junction plane or swivel connection 14 between the handle and cylindrical body portions of the hair dryer appliance 10 is inclined at an angle of approximately 45° to the central axis of the body portion 11 so that the two different hair dryer configurations can be obtained by a mere rotation of the handle 12** about its own axis.

Toward the front end of the cylindrical body housing **11*a* there are located two hot air outlets 15 and 16, air outlet 15 being used with the hair dryer in its gun-type configuration and air outlet 16 being used in its styler configuration. An air inlet 18 is provided toward the back end of the body housing 11*a*. Metal protective grills 20 and 21 are provided covering the air outlets 15 and 16, respectively, in order to prevent hair, fingers, or any other objects from protruding into the cylindrical body portion 11** and toward the electrical heating elements contained therein.

In order to turn on the hair drying appliance 10 and to set it at its various heat levels and fan speeds, there is provided a control switch assembly 23. As shown in FIG. 1, the switch assembly 23 is positioned in the handle 12 so that the switch assembly will be positioned toward the front and inside of the hair dryer appliance while in the gun-type configuration. When the handle is rotated into the styler configuration the switch assembly 23 will be located at the top of the unit.

In order to secure the handle portion 12 against accidental displacement with respect to the body portion 11, there is provided a locking button 75 which will secure the handle 12 in proper position with respect to the cylindrical body portion 11 for the two alternative modes or configurations of the hair dryer. The structure and operation of the locking button 75 will be described hereinafter.

Inside the housing **11*a* there is contained a small D.C. motor 34 for driving a set of fan rotor blades 36 of an axial fan assembly 35. Surrounding the motor 34 and channeling the air flow from the air inlet 18 toward the fan rotor blades 36 are a set of fan stator blades 37. A standard diode bridge package 39 is attached to the back of the motor 34** and is used to convert the AC electrical supply to DC.

Within the housing **11*a* and forward of the fan assembly 35, there is secured a heating assembly 40, including several intersecting mica boards 41 which support hair dryer heating elements 42. The mica boards 41 and heating elements 42 are shown in section in FIG. 6. Centrally disposed within the heating assembly 40 are two thermostats 43** which prevent the temperature of the hair dryer appliance from exceeding a desired temperature level.

The cylindrical body portion 11 is constructed such that upon energization of the motor 35, the fan rotor blades 36 will rotate drawing air in through air inlet 18, through the stator blades 37, past the heating elements 42 and out through one of the air outlets. Without any obstructions, the air current pattern will carry the air flow axially along the cylindrical body portion 11 of the hair dryer 10, and out the air outlet 15. The vanes of grill 21 of the air outlet 16 are also slightly angled upwardly and forwardly, as shown in FIG. 2, to discourage and further deter air from exiting through the air outlet 16 when the hair dryer 10 is used in the gun-type configuration.

Figures 3, 4, 5:
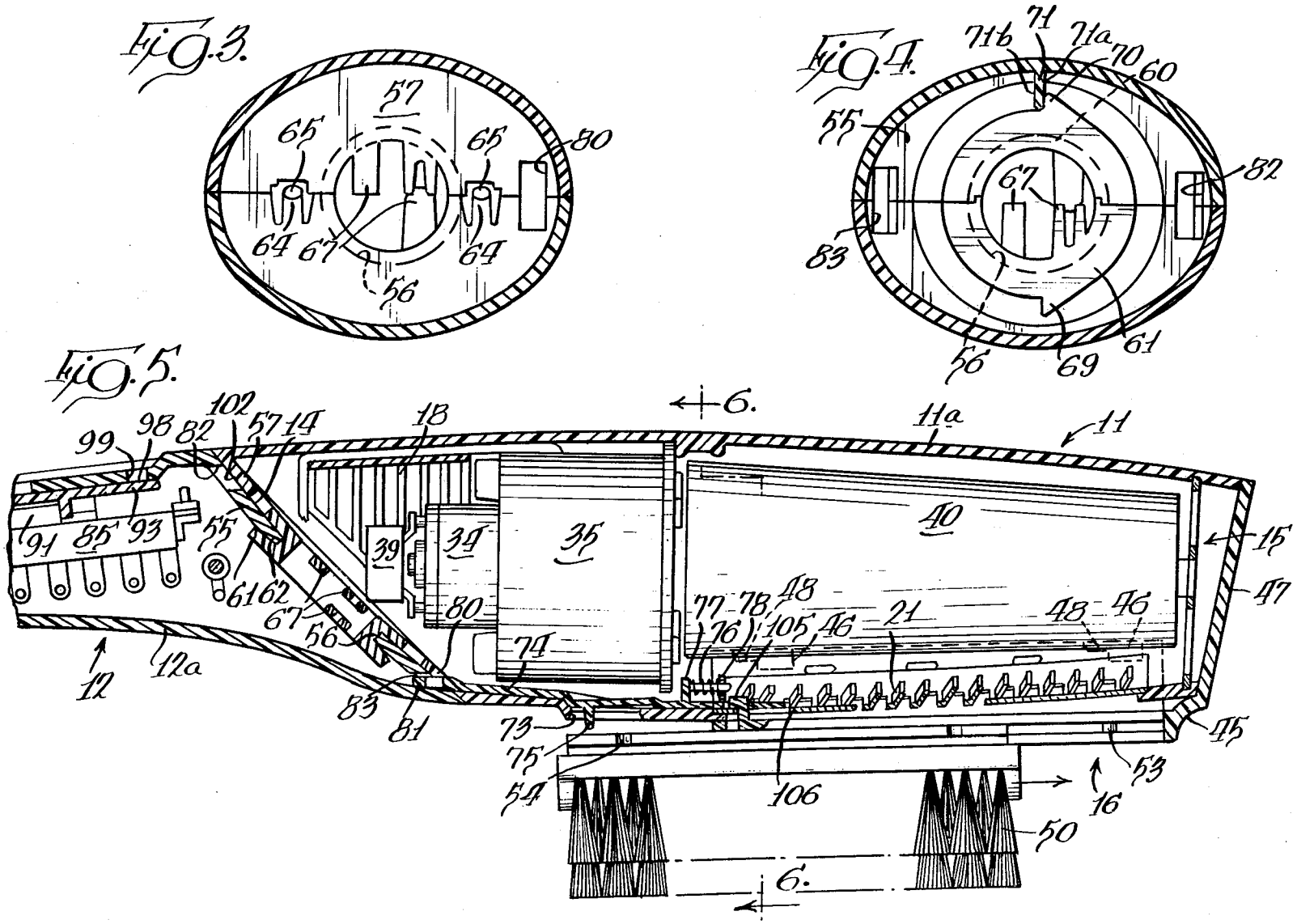
FIG. 3 is a sectional view taken generally on line 3—3 of FIG. 2 but rotated 90° counter-clockwise and looking in one direction toward the swivel connection between the main body portion and the handle portion.
FIG. 4 is a sectional view taken generally on line 4—4 of FIG. 2 but rotated 90° counter-clockwise and looking in the opposite direction toward said swivel connection.
FIG. 5 is a partial sectional view similar to FIG. 2 with the hair drying appliance in its alternative configuration and also showing an attachment mounted thereon.

An attachment adaptor 45 is provided which is adapted to be secured to the cylindrical body portion housing **11*a* only when the handle 12 is rotated to its in-line position of its hair styler/dryer configuration. The adaptor 45 is secured to the housing 11*a* by four pegs or pins 48 which fit into four bayonet-type slots 46, two each of which slots 46 are located on each side of the air outlet 16 provided in the hair dryer housing 11*a*. The front portion of the adaptor 45 is also characterized by an upturned plate member 47 which extends across the front end of the housing 11*a* and serves to block the air outlet 15 provided therein, as is best shown in FIG. 5. Thus, when the adaptor 45 is in position, the air flow will be directed or forced out through air outlet 16. For reasons that will be described hereinafter, only after the adaptor 45 has been detached from the body portion 11 can the handle portion 12 be rotated to its position generally perpendicular to the cylindrical body portion 11 whereby the hair dryer appliance 10 can be used as a typical gun-type blower/dryer with hot air exiting through the air outlet 15**.

By rotating the handle 12 to its position in line with the cylindrical body portion 11 and by securing the adaptor 45 thereto, the hair dryer appliance 10 can be used as a conventional styler/dryer with hot air being directed out through the air outlet 16, the air outlet 15 being blocked by the adaptor plate 47. Various attachments, such as a brush 50 shown in FIG. 5 and FIG. 6, can be secured to the adaptor 45 for use in styling the consumer's hair.

Figure 6:
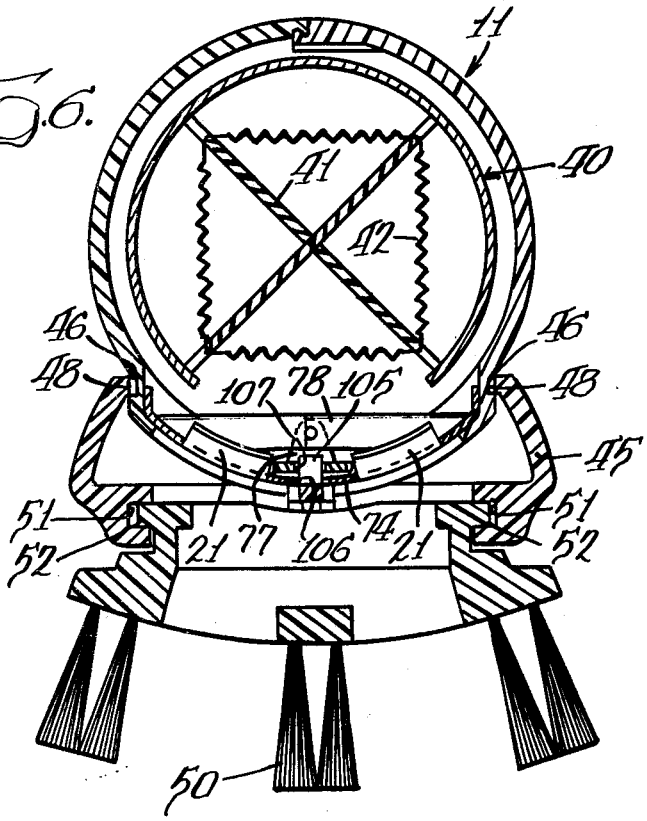
FIG. 6 is a transverse sectional view taken generally on line 6—6 of FIG. 5.

As best shown in FIG. 6, the adaptor 45 is provided with elongated slots 51 on opposite sides thereof in which ledges or flanges 52 formed on the brush 50, or other similar attachment, may be slidably inserted. Each slot 51 is provided with a detent rib or tab 53, as is best shown in FIG. 5, which tabs resiliently engage corresponding detent notches 54 formed on the flanges 52 of the brush attachment thereby resiliently locking the attachment onto the adaptor 45. The brush 50, or other similar attachment, such as a comb, can be slidably inserted onto the adaptor 45 in the direction of the arrow shown in FIG. 5.

As previously noted, the hair dryer appliance 10 of the present invention includes the handle portion 12 which can be rotated through a swivel connection with respect to the cylindrical body portion 11 in order to alternate the hair dryer between a gun-type blower/dryer configuration and an in-line styler/dryer configuration. In order to accomplish this rotation, the handle housing 12*a* is provided at its end adjacent the junction plane 14 with an end wall 55 having a centrally disposed circular hole 60 defining an annular edge 56. As best shown in FIG. 2 and FIG. 5, the cylindrical body housing 11*a* adjacent the junction plane 14 is provided with a centrally bored end wall 57 having a pulley type formation projecting outwardly therefrom. The pulley type formation is characterized by an enlarged head 61 with an annular slot 62 being defined between the head 61 and the end wall 57. The annular edge 56 of the hole 60 in the end wall 55 of the handle housing 12*a* rotatably fits within the annular slot 62 formed at the end of the cylindrical body housing 11*a* to provide the swivel connection therebetween. In order to insure proper tension between the handle and the cylindrical body housings, there are also provided resilient tabs 64 formed in the end wall 57 of the body portion housing 11*a*. The tabs 64 contain raised end members 65 which abut the end wall 55 of the handle housing 12*a* thereby maintaining the desired pressure between the handle and cylindrical body housings. Thus, with the junction plane 14 being at approximately 45° with respect to the cylindrical body and handle axes, rotation of the handle 180° about its own axis will change the hair dryer 10 from the gun-type configuration to the in-line configuration or the reverse thereof. The end wall 57 of the cylindrical body portion 11*a* is also provided with a series of projections or fingers 67 which extend into the central bore formed therein and through which an electrical cord 68 can be woven and secured, as is best shown in FIG. 2.

As best shown in FIG. 4, the head 61 is formed on its periphery with two diametrically opposite projections 69 and 70. Interacting with the projections 69 and 70 there is formed on the handle housing 12*a* a stop plate 71 containing sides 71*a* and 71*b*. The stop plate 71 acts to prevent rotation of the handle housing more than 180 degrees with respect to the cylindrical body housing. With the hair dryer appliance in its gun-type configuration, projection 70 will abut the stop plate 71 at side 71*a* and prevent further relative rotation of head 61 in the counter-clockwise direction as shown in FIG. 4. Upon rotation of head 61 in the clockwise direction, projection 69 will abut stop plate 71 at side 71*b* preventing a rotation greater than 180 degrees at which point the hair dryer appliance 10 will be in its in-line styler/dryer configuration.

In order to lock the relative positions of the handle portion 12 with respect to the cylindrical body portion 11 in the two alternative configurations of the hair dryer appliance, there is provided a locking lever 74 best shown in FIG. 2 and FIG. 5 at the bottom of the cylindrical body portion 11. The locking lever 74 carries the operating button 75 which extends outwardly through an opening 73 in housing 11*a*. The locking lever 74 is spring biased rearwardly by a coil spring 76 which is seated between a locking lever extension 77 and a stop member 78 formed in the housing 11*a*.

The actual locking operation is accomplished by a rear end 81 of the locking lever 74 extending through a passageway 80 formed in housing 11*a* and into either a slot 82 or a slot 83, both of which are formed in the handle housing 12*a* in diametrically opposite position, slot 82 being aligned with passageway 80 when the hair dryer appliance is in its gun-type blower/dryer configuration and slot 83 being aligned with passageway 80 when the handle 12 has been rotated to the in-line styler/dryer configuration. Thus, as best shown in FIG. 2 with the blower/styler configuration, rear end 81 of the locking lever 74 is spring biased within slot 82 and prevents any rotation of the handle 11 with respect to the body portion 12. In the styler/dryer configuration, the locking mechanism, as shown in FIG. 5, has rear end 81 of the locking lever 74 biased into engagement within slot 83. In order to alternate the hair dryer appliance from the blower/dryer configuration to the styler/dryer configuration, for example, the user pushes the locking lever forward by pushing the operating button 75 toward the right, as shown in FIG. 2, thereby disengaging end 81 from the elongated slot 82, and rotates the handle portion 12. As the handle portion is rotated into its in-line position with the cylindrical body portion 11, the elongated slot 83 will become aligned with the passageway 80 thereby allowing the spring biased locking lever 74 to be inserted therein, thus locking the appliance in its styler/dryer configuration.

Figure 7:
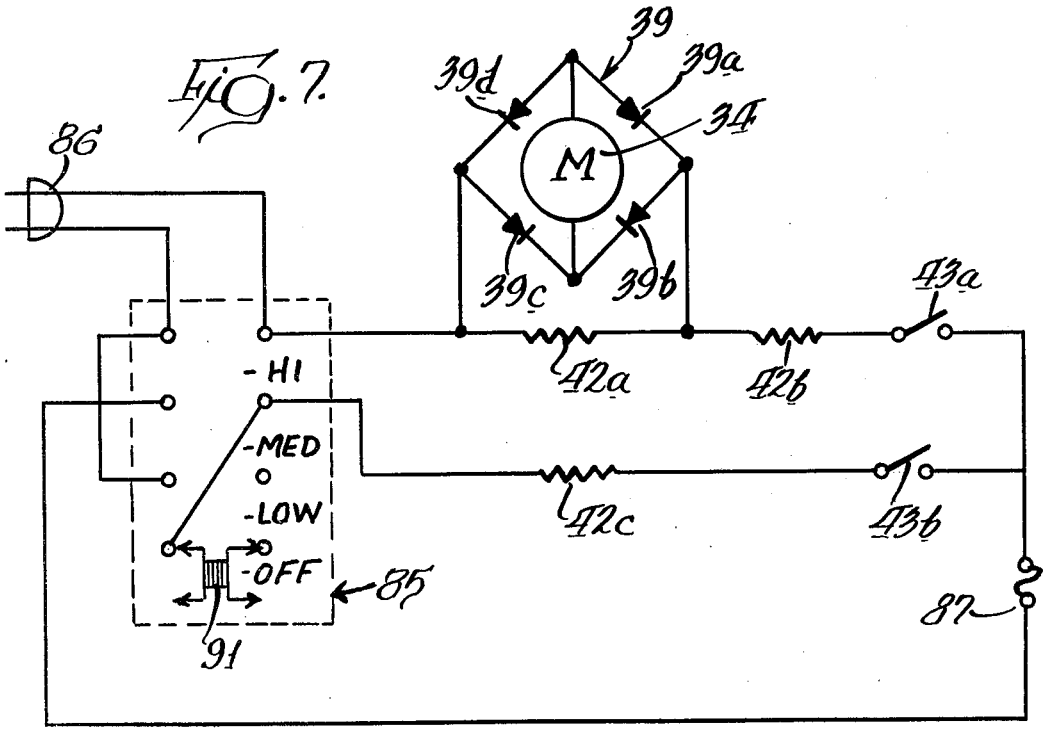
FIG. 7 is a schematic wiring diagram of the electrical circuit of the hair drying appliance embodying my invention.

The hair dryer appliance of the present invention may be operated at three different heating levels and two different fan speeds. Specifically, a faster fan speed is used with the high and medium heating levels whereas a slower fan speed is used with the low heating level. FIG. 7 shows the schematic wiring diagram of the circuit of the present invention. As shown therein, there is a four-position electrical slide switch 85 making two separate electrical connections in each position. The heating elements 42 are also shown in FIG. 7 as schematically represented by three separate heating elements, 42*a*, 42*b*, and 42*c*. The thermostat 43, is also shown schematically in FIG. 7 as comprising two separate thermostatic switches 43*a* and 43*b*, each being connected in series in the two primary heating element lines. Power is supplied to the circuit through a typical AC power plug 86. With switch 85 in the high position, approximately 1200 watts of power is dissipated as all three heating elements are in use, the series combination of elements 42*a* and 42*b* connected in parallel with element 42*c*. When the electrical switch 85 is moved to the medium position, power is supplied only to the heating elements 42*a* and 42*b*. Finally, in the low position, the lowest wattage and lowest heat output is obtained where all three heating elements are connected in series with each other. Also, as shown in FIG. 7, the D.C. motor 34, together with the diode bridge package 39 including diodes 39*a*, 39*b*, 39*c* and 39*d*, is connected in parallel with the heating element 42*a*.

The mechanical structure of the switch assembly 23 is best shown in FIG. 2. A switch housing 85*a* is secured within the handle housing 12*a* in a known manner by housing projections and supporting members 89*a*, 89*b*, 89*c* and 89*d*. Electrical connector tabs or contacts 90 are located on the back side of the switch housing 85*a*. On the opposite side of switch housing 85*a* there is located a slide button 91 for varying the several electrical positions of the switch 85. Overlying the slide button 91 there is provided an elongated switching lever 93 with a raised button portion 94. The button portion 94 extends through an opening 95 provided in the housing 12*a*. As the button portion 94 is moved back and forth by the consumer, the slide button 91 of switch 85 will correspondingly be moved to its various positions. Indicia marking the "off", "low", "medium", and "high" positions of the switch 85 may be imprinted on the outer face of the switching lever 93 at locations 98*a*, 98*b*, 98*c* and 98*d*, respectively. The particular indicia corresponding to the location of the switching lever 93 and the similarly corresponding electrical position of slide switch button 91 is readily visible through an opening 99 provided in the housing 12*a*.

When the hair dryer appliance 10 is in its gun-type blower/dryer configuration, as shown in FIG. 2, and the switching lever 93 is moved into its position for the high wattage setting, the end of switching lever 93 adjacent indicia 98*a* protrudes through both the elongated slot 82 in handle casing 12*a* and an opening 101 provided in the rear end 81 of locking lever 74, locking lever 74 also having its rear end 81 disposed in slot 82 in handle casing 12*a*, as previously described herein. With this structural arrangement, with the hair drying appliance 10 in its gun-type blower/dryer configuration and the switching lever 93 in its high wattage position, the locking member 74 may not be disengaged from its locking engagement with the handle casing 12*a* and the handle 12 may therefore not be rotated into its in-line styler/dryer configuration, thus insuring against high wattage use of the appliance when in its styler/dryer configuration, as will be discussed further herein.

With the hair-dryer in its in-line styler/dryer configuration, it is not desirable to allow operation of the appliance 10 in its highest wattage mode in that with the air outlet 15 being blocked and only air outlet 16 being open there will be insufficient continuous air flow to prevent an undesirable heat build-up. Therefore, in order to prevent use of the appliance 10 in its high wattage mode when in its styler/dryer configuration, the movement of switching lever 93 is blocked before its high wattage position can be reached. Specifically, if the switching lever 93 is moved toward the right, as shown in FIG. 5, in an attempt to obtain the high wattage setting, the end of lever 93 adjacent indicia 98*a* will extend through slot 82 in handle casing 12*a* but will then abut a portion 102 of the end wall 57 of the housing 11*a*, thereby preventing any further movement of the switching lever 93 into its high wattage position.

As a further safety feature of the present invention, means are provided whereby the adaptor 45 and its front plate member 47 for blocking air outlet 15 cannot be attached to the casing 11*a* when the hair dryer 10 is in its gun-type blower/dryer configuration. The adaptor 45 is provided with an upwardly projecting inverted L-shaped latch member 105, as shown in FIG. 5, which latch member is adapted to extend through an opening 106 provided in the grill 21 and to be latchingly engaged in a hole 107 provided in the forward end of the locking lever 74. Thus, in order for the adaptor 45 to be attached to the hair dryer 10 with pegs 48 properly secured within the slots 46, it is necessary that hole 107 be movable into a properly aligned position to receive and latchingly engage the L-shaped latch member 105. In the gun-type configuration of the appliance 10, the locking lever 74, in its normal rearwardly biased position, will be slightly forward of its corresponding position in the in-line configuration, as will now be described. As shown in FIG. 5, slot 83 is formed such that when the hair dryer appliance is in its styler/dryer configuration, there will be ample clearance in slot 83 to allow sufficient rearward movement of the locking lever 74 to permit proper latching engagement of the latch member 105 of the adaptor 45 in the hole 107 formed in the forward end of the locking lever 74. However, in the gun-type configuration, FIG. 2, the design of notch 82 is such that the rear end 81 of the locking lever 74 engages an edge thereof and thus can not move rearwardly far enough to provide proper latching engagement of either the pegs 48 in the slots 46 or the latching member 105 in the hole 107 in the locking lever 74. It is therefore seen that the structural arrangement of the appliance 10 is such that the adaptor 45 may only be properly attached to the housing 11*a* when the appliance is in its in-line styler/dryer configuration.

While there has been shown and described a single embodiment of the present invention, it will be apparent to those skilled in the art that numerous changes and modifications may be made without departing from the invention into broader aspects and it is, therefore, contemplated in the appended claims to cover all such changes and modifications which fall within the true spirit and scope of the present invention.

What is claimed as new and desired to be secured by Letters Patent of the United States is:

1. A combination hair drying appliance comprising a housing, a motor actuated fan mounted in said housing, an air inlet means and air outlet means formed in said housing, heater means mounted in said housing between said fan and said air outlet means, said housing being characterized by an elongated cylindrical portion having an elongated handle portion connected to one end thereof, said handle portion being rotatably movable with respect to said cylindrical portion between a first position in which said handle portion is substantially perpendicular to said cylindrical portion and a second position in which said handle portion is in longitudinal coaxial end-to-end alignment with said elongated cylindrical portion, said air outlet means including a first opening provided at the opposite end of said cylindrical portion from said connected end in longitudinal alignment with said fan and a second elongated, longitudinally extending opening provided in a side wall of said cylindrical portion adjacent said opposite end of said cylindrical portion, said fan causing air to flow through said cylindrical portion whereby said air is heated by said heating means and discharged primarily through said first opening, and adapter means selectively mountable on said cylindrical housing portion adjacent said second opening of said air outlet means and having plate means for blocking said first opening whereby said heated air is discharged through said second opening generally at an angle to the axis of said cylindrical housing portion.

2. A combination hair drying appliance as claimed in claim 1 wherein said connected end of said cylindrical housing portion abuts the end of said handle housing portion to which it is connected along a junction plane, said junction plane being disposed at an angle of approximately 45° with respect to each axis of said two housing portions, and means on the abutting ends of said two housing portions for rotatably attaching said cylindrical portion to said handle portion whereby one portion swings about the axis of the other portion.

3. A combination hair drying appliance as claimed in claim 2 wherein said attachment means comprises a circular opening formed in a first end wall provided at the abutting end of one of said housing portions and defining an annular edge, a cylindrical extension formed on a second end wall provided at the abutting end of the other of said housing portions, said extension extending through said opening and having an enlarged head defining an annular slot between said head and said second end wall of said other housing portion with said annular edge of said opening being rotatably received within said annular slot whereby said two housing portions are rotatably interconnected.

4. A combination hair drying appliance as claimed in claim 3 wherein said attachment means further comprises a pair of diametrically opposite projections extending laterally from said enlarged head of said other housing portion, and a stop plate member on said one housing portion located adjacent said opening whereby engagement of said projections with said stop plate member will limit rotation of said head to 180° in either direction.

5. A combination hair dryer appliance comprising an elongated body portion, a motor actuated fan mounted in said body portion, an air inlet and first and second air outlets formed in said body portion, heater means mounted in said body portion between said fan and said air outlets, said first air outlet being generally axially aligned with said fan and said second air outlet being disposed forwardly of but to one side of the axis of said fan, an elongated handle portion rotatably attached to said elongated body portion, said handle portion being rotatable with respect to said body portion between a first position in which said handle portion is in longitudinal coaxial end-to-end alignment with said body portion and a second position in which said handle portion is angled with respect to said body portion, said fan causing air to flow through said body portion past said heating means and to be discharged primarily through said first air outlet, and means selectively mountable over said first air outlet only whereby said heated air is discharged through said second air outlet.

* * * * *